US007210518B1

(12) United States Patent
Saraiva et al.

(10) Patent No.: US 7,210,518 B1
(45) Date of Patent: May 1, 2007

(54) HORIZONTAL CASTING PROCESS FOR METAL ALLOYS

(75) Inventors: Joao C. Saraiva, Sheffield Village, OH (US); Norman M. Lazarus, Houston, TX (US)

(73) Assignee: National Bronze and Metals, Inc., Houston, TX (US)

( * ) Notice: Subject to any disclaimer, the term of this patent is extended or adjusted under 35 U.S.C. 154(b) by 0 days.

(21) Appl. No.: 11/338,072

(22) Filed: Jan. 24, 2006

(51) Int. Cl.
*B22D 11/00* (2006.01)

(52) U.S. Cl. ..... 164/459; 164/477

(58) Field of Classification Search ..... 164/459, 164/460, 477, 133
See application file for complete search history.

(56) References Cited

FOREIGN PATENT DOCUMENTS

JP 2000336442 A * 12/2000
JP 2005248303 * 3/2004

* cited by examiner

*Primary Examiner*—Len Tran
(74) *Attorney, Agent, or Firm*—Fulbright & Jaworski LLP

(57) ABSTRACT

A novel process for the continuous casting of lead-free bronze alloys. By careful control of such factors as the melt temperature, order of addition of alloy components, cooling temperature and withdrawal rates, continuous casting of high quality lead-free bronze alloys can be achieved.

13 Claims, No Drawings

HORIZONTAL CASTING PROCESS FOR METAL ALLOYS

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A COMPACT DISK APPENDIX

Not Applicable.

TECHNICAL FIELD

The invention relates to a novel method for continuously casting of lead-free bronze alloys. The method provides a means for efficiently producing significant quantities of lead-free alloys, by control of such parameters as melt temperature, holding temperature, cooling rate, exit temperature and draw rate.

BACKGROUND OF THE INVENTION

Continuous casting of metal alloys is used to produce large volumes of high quality metal alloys. While the initial capital investment is higher than for the other traditional casting methods, continuous casting allows for the economical casting of large volumes of metals and alloys.

While the general steps of the continuous casting process are the same for almost all metal and alloys, specific parameters, such as melt temperature, cooling rates, draw rates, die dimension vary significantly from metal to metal. In addition, the tolerances permitted by different metals and alloys is very small. Failure to maintain the proper parameters in the process can lead to catastrophic results.

Lead-free bronze alloy or those alloys about having a lead content of about 2 wt % or less, typically less than about 0.10 weight percent lead. Of particular interest is lead-free bronze alloys that contain low amounts of zinc, e.g. 2.0 wt % or less. These alloys are particularly useful when dezincification is an issue.

Until now, low lead alloys have been cast using either sand casting or investment cast process. While these processes generally involve less capital investment, they are not amenable to the casting of significant volumes of alloy. Thus, there exists a need for a method of continuously casting lead-free alloys.

BRIEF SUMMARY OF THE INVENTION

The invention is a method for continuously casting lead-free bronze alloys. This method allows for the casting of significant volumes of bronze alloy bars or ingots, well in excess of that achieved by other process.

The term lead-free alloys means that the finished alloy will have a lead content of less than 2 wt % with less than about 0.10 wt % preferred. By the term low-zinc, it is meant that the zinc content of the finished alloy will range from about 0.50 wt % to about 2.0 wt % with less than or equal to about 1.3 wt % preferred.

The first step of the method is the preparation of the alloy. This is accomplished by melting and mixing the alloy components which include copper, copper nickel alloys, aluminum, iron, silicon and zinc. The alloy used in the invention are typically prepared by first melting the copper component to a temperature well above the liquidus point of copper, i.e., >1983° F. In at least one embodiment, a temperature of from about 2250° to 2275° F. is used with yet another embodiment using a temperature of 2175° F. to melt the copper component. The remaining components of the mixture are then added and melted sequentially depending on the desired alloy to be achieved.

Once the molten alloy has been formed and adequately mixed, the molten alloy is then transferred to a holding furnace where the mixture is maintained at a temperature above the liquids point. In one embodiment, this temperature ranges from about 2200° to 2250° F. with 2225° F. preferred. While the molten alloy is in the holding furnace, residual hydrogen and oxygen are removed to prevent vapor entrapment in the final product.

The molten alloy is then transferred from the holding furnace to the die or dies where the alloy is cooled and shaped. The alloy is cooled to a temperature below the liquidus point. In one embodiment, the alloy is cooled to about 1050° to 1100° F. The cooled alloy is drawn out of the die by means of rollers which are spaced away from the die to allow additional cooling but close enough to provide support to the alloy as it leaves the die and cools further. The now solid alloy is then cut into the desired length.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

The invention is a novel method for making lead-free bronze alloys in a continuous process. More specifically, it entails using a horizontal continuous process to cast lead-free bronze alloys into bars, ingots or other shapes.

A. Preparing the Alloy

The first step in the process of preparing the alloy. This is accomplished by melting and mixing copper, zinc, iron, and other alloy components together in a melting furnace. The components are then thoroughly mixed to ensure an even distribution throughout the alloy.

The order of addition of the alloy components is important in that it can effect the properties of the finished alloy. For example, in one embodiment, a lead-free alloy is prepared by first introducing copper into the furnace followed by copper nickel alloy, iron, aluminum, silicon and finally zinc. In this process, the individual components are allowed to melt and mix in to the alloy before the next component is added.

Once the various components have been melted in the furnace, the alloy should be thoroughly mixed to ensure an even distribution of the components throughout the molten alloy. Any conventional method for mixing the alloy components can be used. For example, in one embodiment, the melting and mixing of the components is accomplished in low frequency coreless melting furnace to ensure through melting and mixing of the components.

The melt temperatures used in the melting furnace are well above the liquidus point of the components used to make the alloy. In the case of lead-free bronze alloys, copper is the key component with a liquidus point of 1983° F. To ensure that the copper and other components melt completely, the furnace is well above this temperature. For example, in one embodiment, a temperature of from about 2225° F. to about 2275° F. is used.

B. Degassing the Alloy

Once the alloy has been prepared in the melting furnace, the alloy is transferred to a holding furnace. This allows for a continuous supply of alloy to the forming die indices while additional batches of alloy are prepared in the melting furnaces.

The holding furnace maintains the alloy at a temperature well above the liquidus point of the alloy components. This temperature is often different than that used to melt the alloy components. In one embodiment, the temperature of the allow is maintained at from about 2200° F. to about 2250° F.

The atmosphere in the holding furnace should be at least slightly de-oxidized to reduce or prevent the alloy from binding with oxygen and/or hydrogen. Entrapment of these gases can lead to porosity in the finished product.

To ensure that the molten alloy is free of entrapped gases, degassing can be performed while the alloy is in the holding furnace. One method used to eliminate entrapped gases is to circulating an inert gas, such as nitrogen, through the molten alloy. The gases force components such as hydrogen out of the alloy and to the surface of the next where it is eradicated.

Reduction of oxygen in the alloy is generally accomplished by the addition of one or more "de-oxidizer" metals to the alloy. Most common of these is aluminum as well as zinc. In addition to de-oxidizing the alloy, these metals also act as grain refiners and the aluminum acts as a barrier to the atmosphere.

The introduction of oxygen and/or hydrogen into the alloy can also be prevented through the use of a protective shield or cover on the surface of the alloy in the furnace. In one embodiment, a protective graphite pellet cover is used to prevent possible oxidation or introduction of hydrogen into the molten alloy.

C. Forming the Alloy

The molten alloy is next transferred to one or more dies where the alloy is cooled and formed into the desired shapes. The number of dies used is dependent on the diameter and shape of the finished product as well as the cooling capacity of the coolers associated with the dies. In one embodiment, from one to three dies are used to form the finished product.

The composition and geometry of the die are important in continuous casting processes. The die must be constructed of a material which permits adequate heat transfer away from the molten alloy while withstanding the heat of the molten alloy The die must also have sufficient length to permit the alloy to solidify just before exiting the die. If the length is too long, the alloy may solidify within the die. If the length is too short, alloy will not be solid enough and may collapse before it reaches the withdrawal rollers.

The length of the die will typically range from about 7.5 inches to about 14 inches. In one embodiment, a twelve inches long die is used. In this embodiment, nine inches of the die extends through the cooler associated with the die. The remaining three inches extend into the molten alloy acting as a conduit for the molten alloy. As noted above, it is important that the length be such that, in combination with such other factors as the composition of the die, the wall thickness of the die and the cooling rate of the associated coolers, the alloy reaches the desired exit temperature.

The composition of the die will also affect the cooling of the alloy. As discussed above, the die should be made of a material which provides excellent heat transfer but can withstand the temperature of the molt alloy. Graphite dies have been found to deliver the desired performance with high thermal conductivity, high strength graphites preferred. In one embodiment, the die is fabricated from Graphite Grade 2191 available from Carbone Lorraine North America Corp.

Die wall thickness will also affect the cooling of the alloy. The thickness should be such that the die has the desired strength yet thin enough to allow sufficient heat transfer. Typical wall thickness range from about 0.21 to about 0.72. In one embodiment, the wall thickness is about 0.2812 inches.

D. Cooling of the Alloy

The shaping dies are generally associated with coolers which aid in transferring heat away from the molten alloy. The coolers generally fine tune by circulating a coolant through a metal jacket associated with the dies to draw heat away from the dies and the alloy. In one embodiment, water is used as a coolant within a closed circulation system. The inner jacket is constructed of a metal with good heat transfer properties such as copper. In one embodiment, the water is circulated at a rate of from about 150 to about 250 gallons per minute ensuring a water temperature of from about 150° F. to about 200° F. In another embodiment, a water flow of about 200 gallons per minute is used.

The coolers generally surround the dies to allow heat transfer from the dies to the coolant. In one embodiment, the cooler is cylindrical in shape with the dies running inside the cylinder along the length of the cylinder. The diameter of the cylinder will depend upon the number and diameter of the dies running through the cooler. For example, where three dies having an outer diameter of about 1.5 inches, a cooler having a diameter of about 4.968 inches is used.

E. Withdrawing the Alloy from the Dies.

Withdrawal of the solid alloy from the die is accomplished by the pressure of the molten alloy forcing the alloy through the die and the withdrawal of the solid alloy by the withdrawal rollers.

The rate at which the alloy is withdrawn from the die, along with the die stroke and geometry, is important in ensuring the continuous casting of the alloy. If the rate is too slow, the alloy will solidify within the die possibly causing a stoppage. If the rate is too fast, the alloy will not have enough time to sufficiently solidify before leaving the die. This can result in collapse of the alloy rod before it reaches the die roller. Withdrawal rates are typically expressed in terms of pounds of alloy per hour. In the process of the invention, withdrawal rates of from about 450 to about 630 pounds per hour are used. The rate will depend on such factors as the alloy being cast and the diameter of the casting. For example, a withdrawal rate of 563 pounds per hour can be used to cast a 1.5 inch diameter cast of a lead-free, low zinc alloy such as NBM 995. This equates to 121.11 times the outer diameter of the cast.

The distance between the withdrawal roles and the die exit should be sufficient to ensure that the alloy has completely solidified before it reaches the exit point of the die. This distance will vary depending on the composition of the alloy and the diameter of the rods produced. In one embodiment, a distance of from about 144 to 145 feet is used.

Alignment of the withdrawal rollers with the shaping die is important to ensure that the resulting bars meet the specification. In one embodiment, lasers are used to ensure that the alignment is correct.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for the continuous production of lead-free bronze alloys comprising:

a) Preparing a "lead-free" molten alloy comprising copper, cupro-nickel, iron, aluminum, silicon and zinc;

b) Transferring the molten alloy into a holding furnace;

c) De-gassing the molten alloy within the holding furnace;

d) Transferring the molten alloy to a casting die;

e) Cooling the molten alloy within the casting die to an exit temperature of from about 1050° F. to about 1100° F.;

f) Drawing the alloy out from the die at a rate of from 450 to about 630 pounds per hour.

2. The process of claim 1 wherein the molten alloy is prepared at a temperature of from about 2225 to about 2275° F.

3. The process of claim 1 wherein the alloy is drawn from the die at a rate of about 563 pounds per hour.

4. The process of claim 1 further comprising the step of cutting the alloy.

5. The process of claim 1 wherein the step of preparing the alloy is accomplished by sequentially melting copper, cupro-nickel, iron, aluminum, silicon and zinc.

6. The process of claim 1 wherein the step of degassing the molten alloy is accomplished by circulating an inert gas through the molten alloy.

7. The process of claim 6 wherein the inert gas is nitrogen.

8. The process of claim 1 further comprising the step of maintaining the molten alloy in the holding furnace at a temperature of from about 2200 to about 2250° F.

9. The process of claim 1 wherein the step of cooling the molten alloy is accomplished by circulating a coolant through a cooling system associated with the die.

10. The process of claim 9 wherein the coolant is water.

11. The process of claim 10 wherein the water is maintaining at a temperature of from about 150° F. to about 200° F.

12. The process of claim 1 wherein further comprising the step of protecting the molten alloy in the holding furnace from exposure to oxygen.

13. The process of claim 12 wherein the step of protecting the molten alloy is accomplished through use of a graphite pellet cover.

* * * * *